United States Patent [19]

Fitzpatrick

[11] Patent Number: 4,547,699

[45] Date of Patent: Oct. 15, 1985

[54] GREEN LUMINESCING CATHODE-RAY TUBE DEVICE

[75] Inventor: Brian J. Fitzpatrick, Ossining, N.Y.

[73] Assignee: North American Philips Corporation, New York, N.Y.

[21] Appl. No.: 453,379

[22] Filed: Dec. 27, 1982

[51] Int. Cl.[4] ..... H01J 29/18; H01J 5/16; H01J 31/00

[52] U.S. Cl. ..... 313/478; 313/112

[58] Field of Search ..... 313/110, 112, 371, 466, 313/478, 474

[56] References Cited

U.S. PATENT DOCUMENTS 3,971,932 7/1976 Sewell et al. ..... 313/388 X 4,106,857 8/1978 Snitzer ..... 350/311

FOREIGN PATENT DOCUMENTS 2098393A 11/1982 United Kingdom ..... 313/478

*Primary Examiner*—David K. Moore
*Assistant Examiner*—K. Wieder
*Attorney, Agent, or Firm*—Norman N. Spain

[57] ABSTRACT

A CRT device for generating a bright green light spot is shown. The device employs a terbium activated phosphor. Troublesome radiations emitted by the phosphor particularly in the 586 nm region are significantly decreased without significant decrease of the desired 544 nm radiation by use of a concentrated solution of a soluble praseodymium salt.

15 Claims, 3 Drawing Figures

GREEN LUMINESCING CATHODE-RAY TUBE DEVICE

BACKGROUND OF THE INVENTION

This invention relates to a new and novel CRT device for generating a bright green light spot of the type particularly useful for projection color television.

Green light radiation for use in projection color television is generally produced by the electronic bombardment of a green luminescing terbium activated phosphor such as a terbium activated yttrium oxysulfide contained in a cathode ray tube.

A problem that has arisen from use of the terbium activated phosphor is that besides the desired fundamental radiation at 544 nm there are also significant radiations at 586, 490 and 620 nm. The radiation at 586 nm is the most troublesome as this radiation is the closest to the fundamental radiation and can cause blurring of the image when the 544 nm radiation is brought into focus.

In order to enhance the contrast of the projected image it has been suggested in Kikuchi et al IEEE Transactions on Consumer Electronics, Vol. CE-27, No. 3, August 1981, pp 478–484 to add a dye to an ethylene glycol-water coolant mixture sealed to the outside of the face plate of the CRT.

However, dyes generally have broad absorption bands and as a result not only is the reduction of the undesired emission achieved but there is also considerable reduction of the desired emission of the 544 nm band.

There is also disclosed in Ogloblinsky, U.S. Pat. No. 2,093,288 the addition of coloring agents to an oil bath located in contact with the outer surface of the face plate of a cathode ray tube in order to eliminate undesired components of light emitting from the phosphor screen of a projection television apparatus.

However, the use of coloring agents broadly, results in the same disadvantages as do the dyes employed by Kikuchi et al.

BRIEF SUMMARY OF THE INVENTION

A principle object of this invention is to provide a cathode-ray tube (CRT) device for generating a bright green light spot in which a terbium activated phosphor is employed and there is considerable suppression of the undesired radiation at 586 nm with little or no suppression of the desired radiation at 544 nm.

Another object of this invention is to provide an externally liquid cooled CRT device for generating a bright green light spot for projection television in which a terbium activated luminescent material is employed and troublesome emissions at 586 nm are suppressed without reduction of the desired emission at 544 nm.

These and other objects of the invention will be apparent from the description that follows.

According to the invention the applicant has developed a new and novel CRT device for generating a bright green light spot employing a terbium activated phosphor capable of emitting green radiation when excited by electrons and in which outside of the face plate portion of the tube envelope and in the path of the green radiation there is positioned, in a transparent container, a transparent light filtering means comprising a concentrated solution of a soluble praseodymium salt.

It has been unexpectedly found that the light emitted from the cathode ray tube device of the invention is practically free of the troublesome emission of the 586 nm band while there is essentially no attenuation of the desired main peak at 544 nm.

While any concentrated solution of a praseodymium salt may be employed preferably the solution contains 15–40% by weight of the praseodymium salt, the solution being most useful when the concentration of the praseodymium salt is from 20–40% by weight.

Examples of solvents that may be employed are water, ethylene glycol, 1,2-propylene glycol, 1,3-propylene glycol, glycerol, ethanol, propanol, isopropanol, methanol and benzyl alcohol and mixtures thereof.

Preferably the solvent consists of 50–80% by weight of an organic solvent preferably selected from those previously listed and water as in such a case the solution may also serve as an excellent coolant for the tube during operation while at the same time being highly resistant to freezing during storage.

Most preferably the solvent consists of about 80% by weight of ethylene glycol and the remainder water.

Preferably the solution is carried on the external surface of the face plate of the tube and is held in place by a glass plate or other transparent member sealed to the external surface of the face plate. In such a position the solution not only serves as a light filtering means but also as a coolant for the tube.

However, if no coolant effect is desired, the solution need not be carried directly on the external surface of face plate but may be contained in a sealed transparent container removably positioned outside of the external surface of the face plate and in the path of the radiation emitting from the phosphor.

Preferably the index of refraction of the container matches that of the face plate.

Any water soluble praseodymium salt may be employed, examples of which are praseodymium acetate, praseodymium bromide, praseodymium chloride, praseodymium iodide and praseodymium nitrate. The praseodymium nitrate is preferred.

Any terbium activated phosphor capable of producing green radiation when excited by electrons may be employed in the CRT device of the invention, examples being terbium activated yttrium oxysulfide (P45), terbium activated lanthanium oxysulfide (P44), and terbium activated yttrium aluminum garnet (P53) all of which are described in "Optical Characteristics of Cathode Ray Tube Screening", (December 1980) Electronic Industries Association, Washington, D.C., and a terbium activated strontium orthophosphate such as is disclosed in U.S. Pat. No. 3,606,324.

The phosphor material may be present in the cathode ray tube as a luminescent screen coated on the inner surface of the face plate but may also be in the form of a single crystal only the surface of which is activated.

GENERAL DESCRIPTION OF THE DRAWINGS

DETAILED DESCRIPTION OF THE PREFERRED EMBODIMENT

Figure 1:
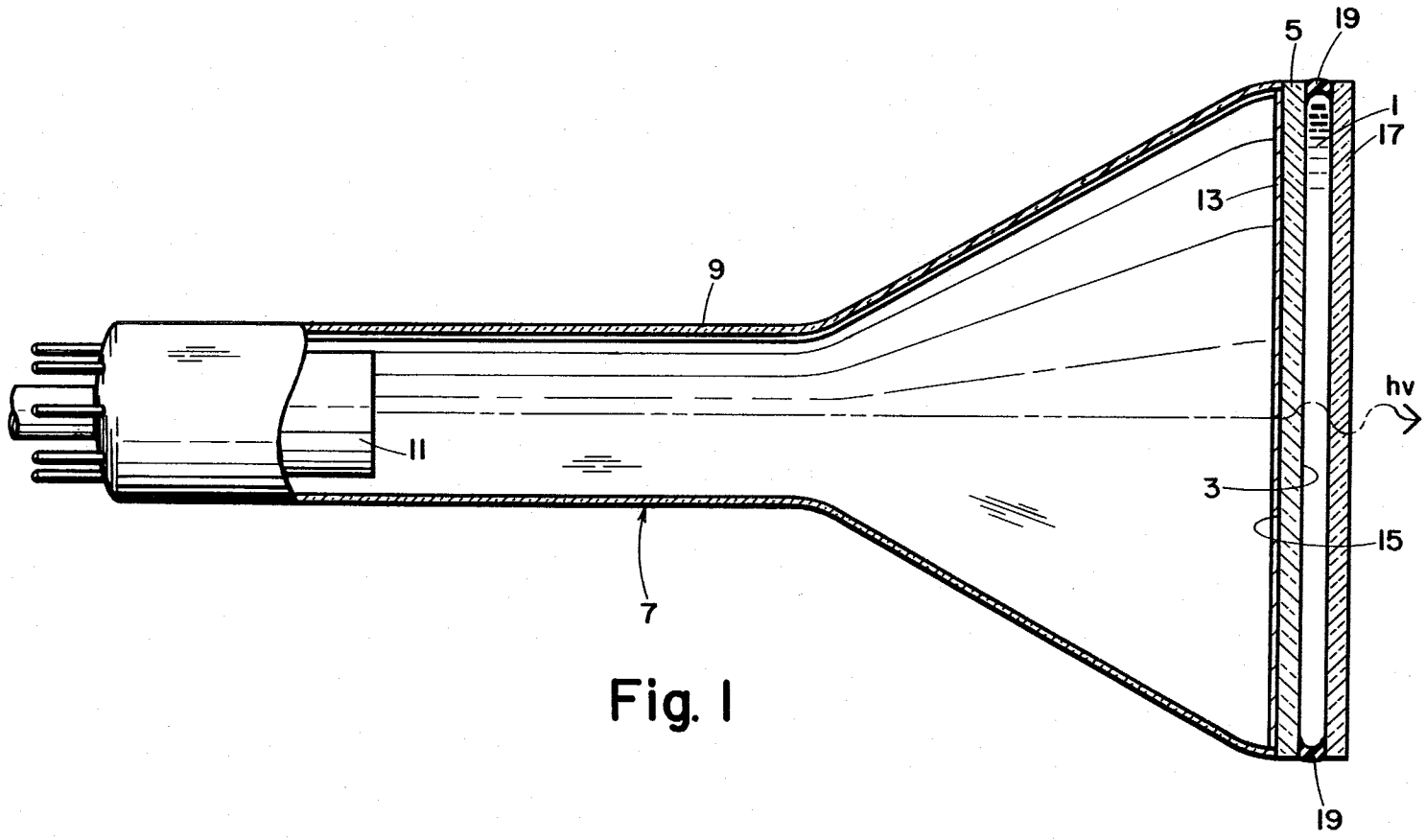
FIG. 1 is a sectional view of a CRT device of the invention.

The invention will now be described in greater detail with reference to FIG. 1 of the drawing which is a cross-sectional view of a preferred embodiment of a CRT device of the invention.

A solution of praseodymium nitrate is prepared by dissolving 8 gm of PR $(NO_3)_3.5\ H_2O$ in a mixture of 4 g of $H_2O$ and 16 gm of ethylene glycol.

A 5 mm thick layer of the resultant light filtering solution 1 is applied to the external surface 3 of the glass face plate 5 of a cathode-ray tube 7 supplied with envelope 9 and containing an electron gun 11 positioned to emit a beam of electrons impinging on the surface of a green fluorescing luminescent screen 13 formed of terbium activated yttrium oxysulfide (P45) deposited on the internal surface 15 of the face plate 5.

The solution layer 1 is held in place on the external surface 3 of the face plate 5 by glass plate 17 and spacers 19.

Figure 2:
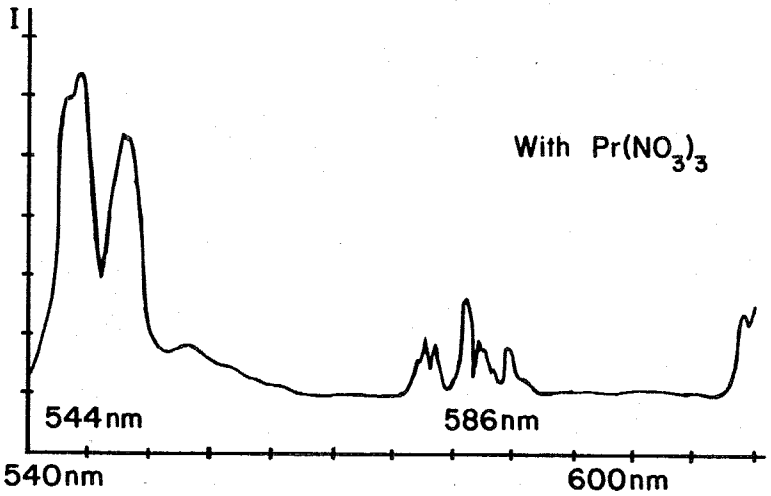
FIG. 2 is a graph showing the spectral energy distribution of the radiation emitted from a CRT device of the invention in the range of 540–600 nm.

The light output of this CRT device upon excitation of the luminescent screen by electrons is scanned with a monochromator in the wave length range of 540 nm–600 nm. The recorded result is shown in the graph of FIG. 2 of the drawing in which the wave length in nm is plotted on the abscissa and the measured intensity in arbitrary units is plotted on the ordinate.

Figure 3:
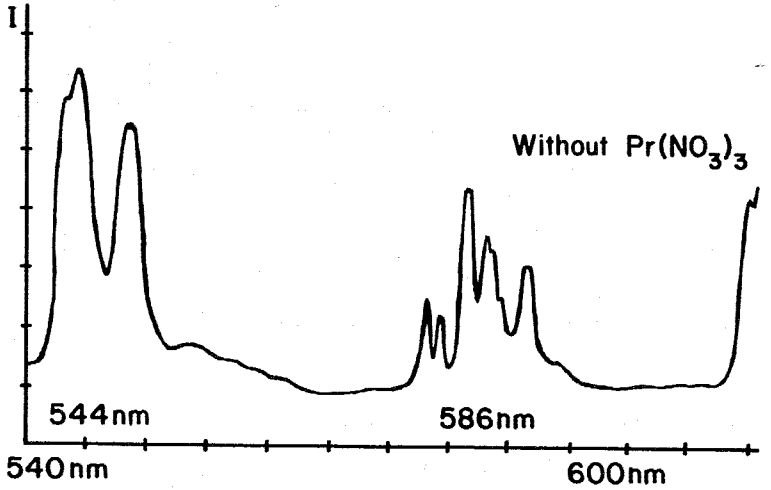
FIG. 3 is a graph showing the spectal energy distribution in the intensity of the radiation emitted from a similar CRT device but without the light filtering means of the invention.

In similar fashion the light output produced by use of an identical CRT device except for the omission of the praseodymium salt from the solution is scanned in the same wave length range. The recorded result is shown in FIG. 3.

An inspection of this recorded result shows use of the praseodymium salt containing solution results in a very large reduction of the lines at 586 nm while leaving the main lines at 544 nm essentially unchanged. There is also some reduction of the radiation in the blue region.

Replacement of the 5 mm thick layer of the salt containing solution with a 3 mm thick solution results in a 52% reduction of the lines at about 586 nm, 12% reduction of the lines at about 489 nm and a 4% reduction of the lines at about 494 nm. No reduction of the emission at 544 nm occurs.

While the present invention has been described with reference to particular embodiment thereof, it will be understood that numerous modifications can be made by those skilled in the art without actually departing from the scope of the invention.

What I claim is:

1. A cathode-ray tube device for generating a bright green light spot comprising:

a cathode-ray tube including an evacuated envelope, means, located within said envelope, to generate an electron beam, a terbium activated phosphor capable of emitting green radiation when excited by electrons and positioned within said envelope and in the path of said electron beam and a transparent face plate forming part of said envelope and situated in the path of said green radiation, and positioned outside of the outer surface of said face plate and in the path of said green radiation, a light filtering means comprising, a container at least the portion of which in the path of said green radiation is transparent to said radiation, said filtering means further comprising a concentrated solution of a soluble praseodymium salt.

2. The cathode-ray tube device of claim 1 wherein a solvent is provided in said solution and said solvent is selected from the group consisting of water, ethylene glycol, 1, 2-propylene glycol, 1, 3-propylene glycol, glycerol, methanol, ethanol, propanol, isopropanol and benzyl alcohol, and mixtures thereof.

3. The cathode-ray tube device of claim 2 wherein said praseodymium salt is selected from the group consisting of praseodymium acetate, praseodymium chloride, praseodymium bromide, praseodymium iodide and praseodymium nitrate.

4. The cathode-ray tube device of claim 3 wherein said solution contains from 15–40% by weight of said praseodymium salt.

5. The cathode-ray tube device of claim 4 wherein said solution contains about 20–40% by weight of said praseodymium salt.

6. The cathode-ray tube device of claim 2 wherein said solvent is a mixture of water and up to 80% by weight of ethylene glycol.

7. The cathode-ray tube device of claim 3 wherein said solvent is a mixture of water and up to 80% by weight of ethylene glycol.

8. The cathode-ray tube device of claim 4 wherein said solvent is a mixture of water and up to 80% by weight of ethylene glycol.

9. The cathode-ray tube device of claim 7 wherein said praseodymium salt is praseodymium nitrate.

10. The cathode-ray tube device of claim 8 wherein said praseodymium salt is praseodymium nitrate.

11. The cathode-ray tube device of claim 10 wherein said solution contains about 22% by weight of praseodymium nitrate.

12. The cathode-ray tube device of claim 1 wherein said light filtering means is sealed to the outer surface of said face plate.

13. The cathode-ray tube device of claim 2 wherein said light filtering means is sealed to the outer surface of said face plate.

14. The cathode-ray tube device of claim 9 wherein said light filtering means is sealed to the outer surface of said face plate.

15. The cathode-ray tube device of claim 11 wherein said light filtering means is sealed to the outer surface of said face plate.

* * * * *